United States Patent [19]

Ritter

[11] Patent Number: 5,010,631

[45] Date of Patent: Apr. 30, 1991

[54] AIR NOZZLE FOR THE INTERLACING OF MULTIFILAMENT YARNS

[75] Inventor: Helmut Ritter, Wattwil, Switzerland

[73] Assignee: Heberlein Maschinenfabrik AG, Wattwil, Switzerland

[21] Appl. No.: 475,835

[22] Filed: Feb. 6, 1990

[30] Foreign Application Priority Data

Feb. 15, 1989 [CH] Switzerland ..... 530/89

[51] Int. Cl.[5] ..... D02J 1/08

[52] U.S. Cl. ..... 28/274

[58] Field of Search ..... 28/271, 273, 274, 275, 28/276

[56] References Cited

U.S. PATENT DOCUMENTS 4,345,425 8/1982 Negishi et al. ..... 28/274 X 4,355,445 10/1982 Matsumoto et al. ..... 28/271 X

FOREIGN PATENT DOCUMENTS 2527653 12/1983 France ..... 28/273

661753 8/1987 Switzerland .

*Primary Examiner*—Werner H. Schroeder

*Assistant Examiner*—John J. Calvert

*Attorney, Agent, or Firm*—Young & Thompson

[57] ABSTRACT

The air nozzle has a continuous yarn channel (3.1) into which terminate laterally an air feed bore (5) and a threading slot (4). The wall of the yarn channel (3.1) contains two cylindrical, for example circular-cylindrical wall sections, namely a baffle wall section (6.1) lying in opposition to the air feed bore (5) and a nozzle wall section (9.1) proximate to the air feed bore (5). The threading slot (4) terminates between the baffle wall section (6.1) and the nozzle wall section (9.1). The tangential plane (T) on the baffle wall section (6.1) at the rim (7) of the orifice of the threading slot (4) passes through the nozzle wall section (9.1). As a result thereof, the portion of the air stream exiting from the air feed bore (5) which is deflected by the baffle wall section (6.1) toward the orifice rim (7) of the threading slot (4), and then leaves the baffle wall section (6.1) in the direction of the tangential plane (T), does not enter into the threading slot (4). Thereby, danger of damage to filaments and filament bundles is reduced since they are not blown into the threading slot (4).

9 Claims, 4 Drawing Sheets

AIR NOZZLE FOR THE INTERLACING OF MULTIFILAMENT YARNS

The invention relates to an air nozzle for the interlacing of multifilament yarns, with a continuous yarn channel into which terminate laterally at least one air feed bore and one threading slot.

The threading slot is required in some cases when the yarn is supplied at a high speed without interruption, such as, for example, at a spinning machine, so that the yarn can be inserted from the side in the yarn channel during operation. In conventional air nozzles with threading slots there is, however, the danger that filaments and filament bundles, carried along with the air stream at some locations along the yarn channel wall, impinge upon the edges of the threading slot and/or enter the threading slot. This, then, leads very easily to damage to the yarn; breakage of filaments and loop formation are not a rarity, especially with the present trend toward finer filaments.

It has also been suggested to provide the air nozzles with a threading slot which is opened for the yarn insertion step and then can be closed again during operation, for example in accordance with Swiss patent No. 661,753. Such air nozzles with movable parts are, however, unsuitable for high speeds and wet operation, for example yarns with freshly applied spinning preparations or spinning finish, because spinning preparation can settle with filament particles between movable surfaces and impair the function of the latter (e.g. sealing action). Besides, operating errors are, of course, also possible in case of air nozzles having movable parts.

Therefore, it is an object of this invention to provide an air nozzle of the type discussed hereinabove which does not require any movable parts, but avoids the danger of damage to the filaments by the threading slot.

The air nozzle according to the invention, attaining this object, is characterized in that the wall of the yarn channel exhibits two cylindrical wall sections, namely a baffle wall section lying in opposition to the orifice of the air feed bore and a nozzle wall section proximate to the orifice of the air feed bore, the threading slot terminating into the yarn channel between the baffle wall section and the nozzle wall section; and that the tangential plane on the baffle wall section containing the orifice rim of the threading slot lying in the baffle wall section passes through the nozzle wall section.

In conventional air nozzles, all of the wall sections of the yarn channel wall lie on a common cylindrical surface, normally a circular-cylindrical surface, with the interruption by the threading slot. The air stream exiting from the air feed bore impinges upon the baffle wall section lying in opposition to the air feed bore and is deflected on this baffle wall section. A portion of the air stream leaves the baffle wall section at the orifice rim of the threading slot essentially in the direction of the tangential plane on the baffle wall section at this orifice rim. This tangential plane, and thus the air stream and filaments and filaments bundles entrained by the air stream, enter the threading slot and impact against its boundary wall. This is avoided in the air nozzle according to the invention; the afore-mentioned tangential plane and the air stream leaving one orifice rim of the threading slot impinge upon the cylindrical nozzle wall section proximate to the orifice of the air feed bore whereas the other orifice rim of the threading slot, as seen from the interior of the yarn channel, lies outside of the aforementioned tangential plane (or, in the limit case, just barely within this tangential plane).

Embodiments of the invention will be described in greater detail below with reference to the drawings wherein.

Figure 3:
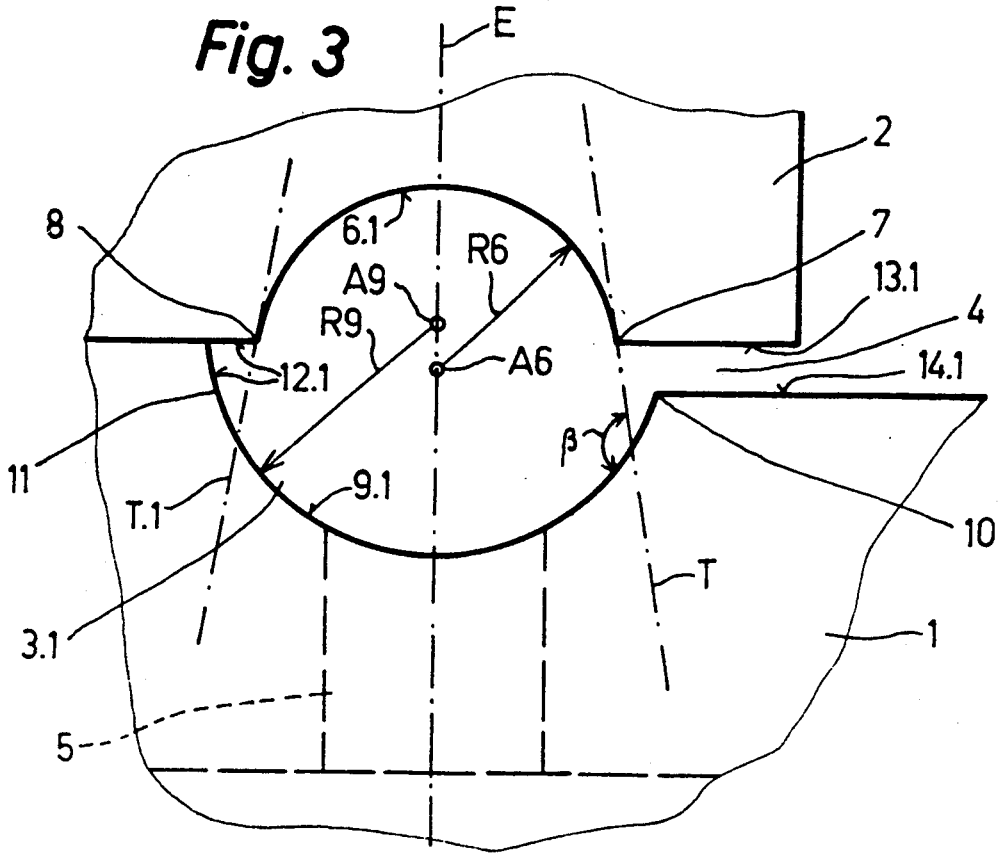
Figure 4:
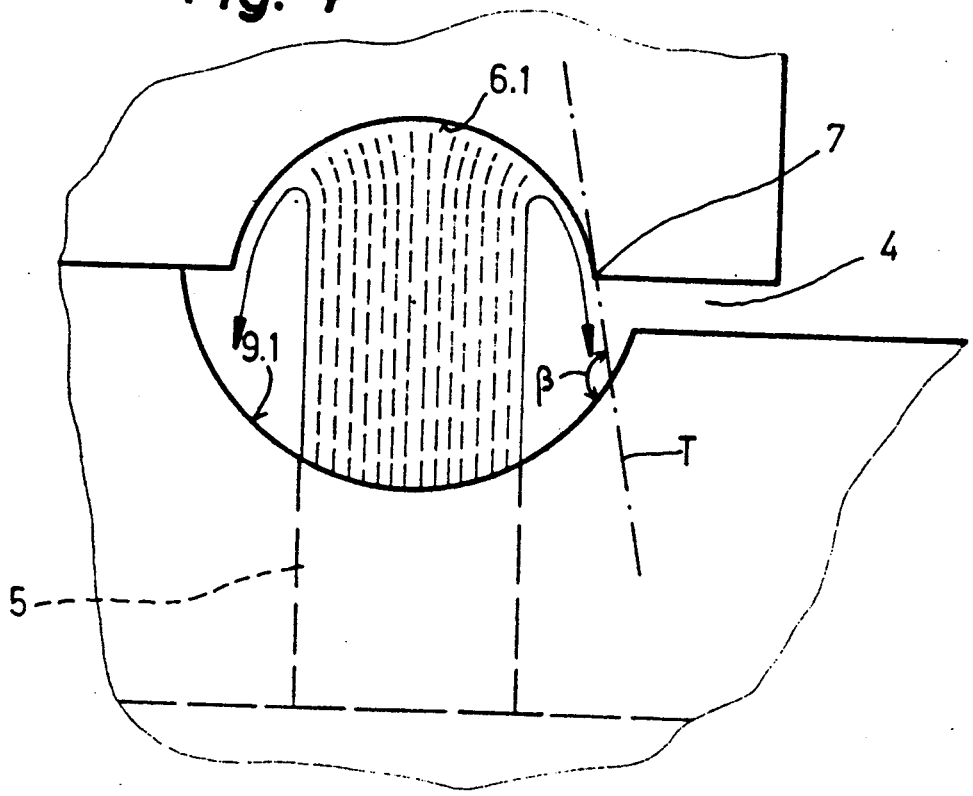
Figure 5:
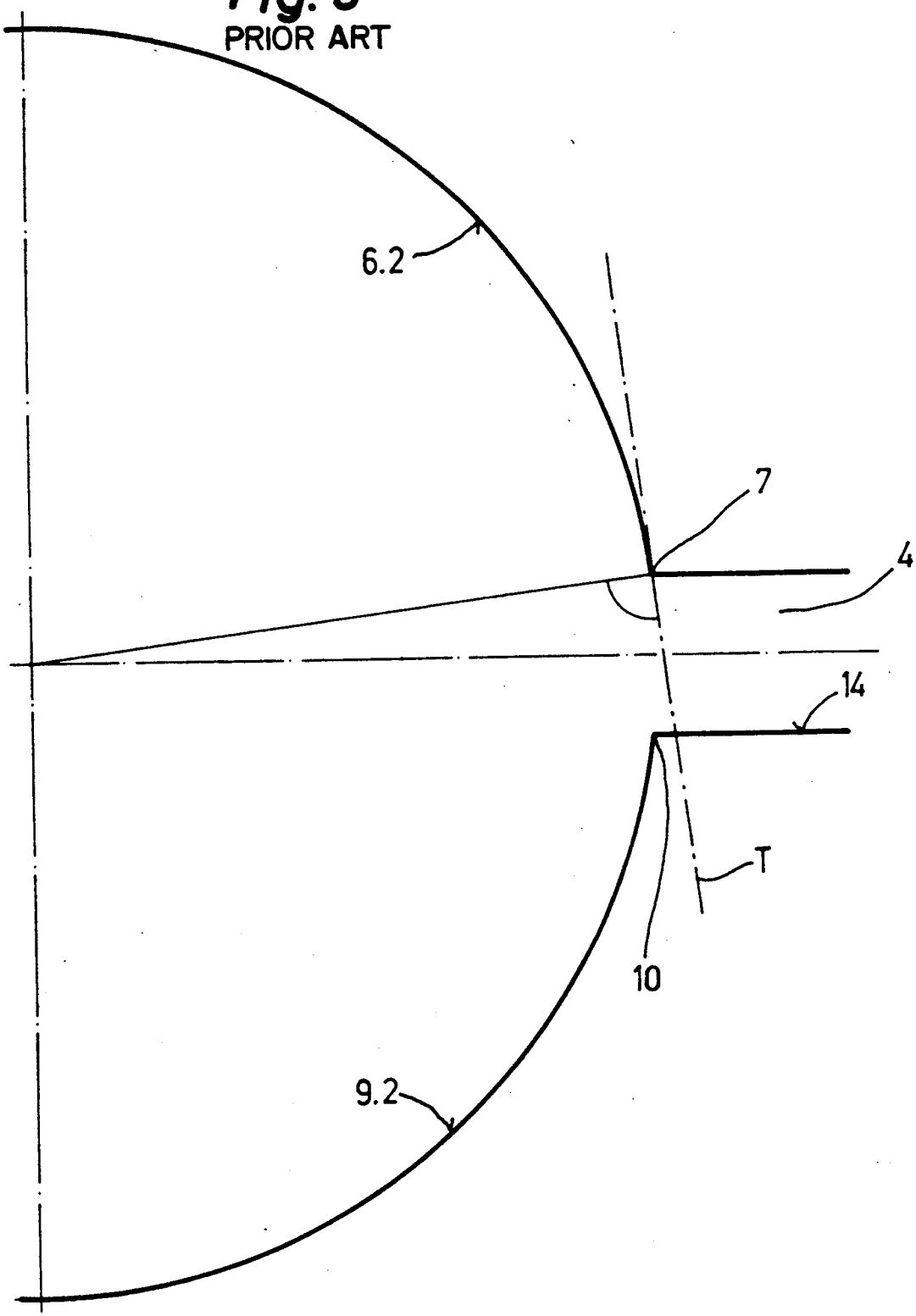
Fig. 5 PRIOR ART
Figure 6:
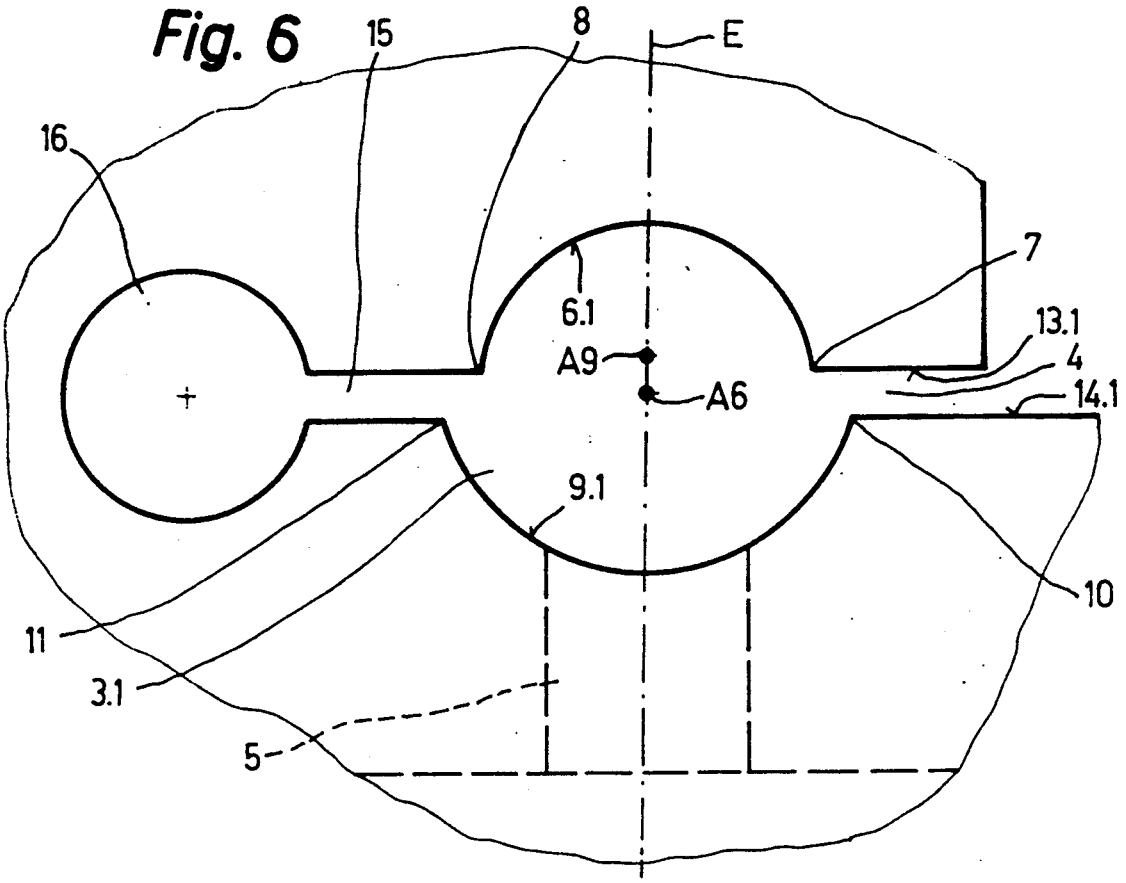

FIG. 3 shows, on an enlarged scale, an end view of the yarn channel of an air nozzle according to this invention, FIG. 4 shows the same view as FIG. 3, with schematically indicated blown air currents, FIG. 5 is a schematic sketch to explain the relationships in conventional air nozzles, FIG. 6 shows, in a view similar to FIG. 3, the yarn channel in a second embodiment of the air nozzle according to this invention, and FIG. 7 shows, again in a similar view, the yarn channel in a third embodiment of the air nozzle according to the invention.

Figure 1:
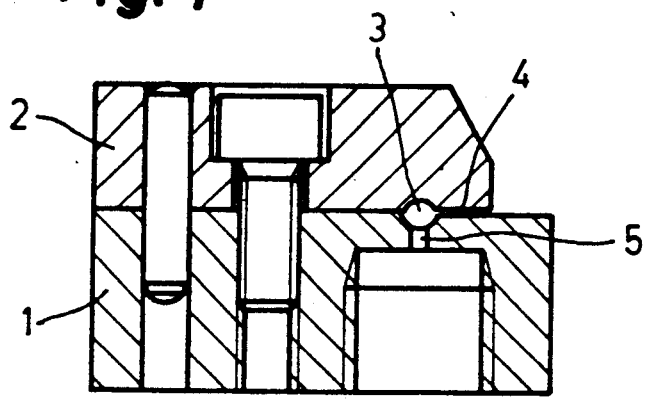
FIG. 1 is a cross section through an air nozzle along line A—A in FIG. 2.
Figure 2:
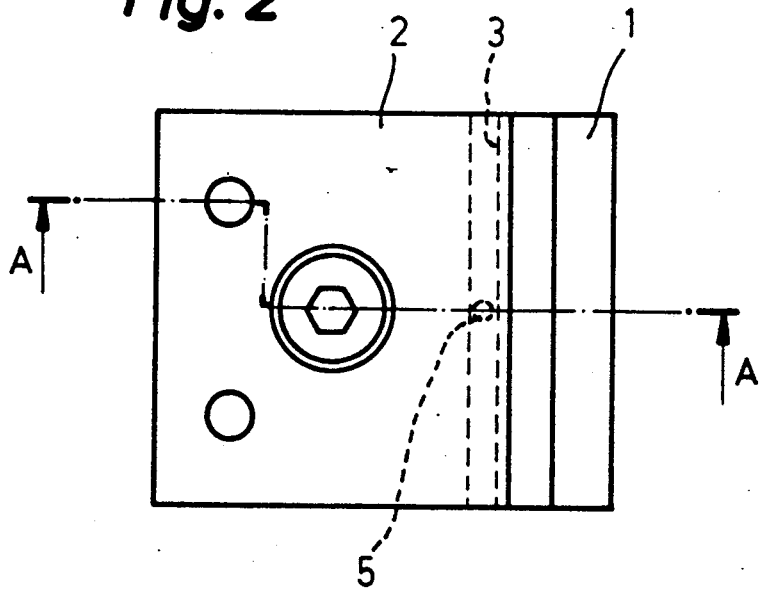
FIG. 2 is a top view of FIG. 1.

The air nozzle illustrated in FIGS. 1 and 2 comprises a nozzle body 1 and a baffle body 2, one fastened to the other. The two bodies 1 and 2 could also be formed integrally with each other. A continuous yarn channel 3 is provided in the form of a recess between the two bodies 1 and 2; a threading slot 4 and an air feed bore 5 terminate laterally into this yarn channel.

A traveling multifilament yarn (not shown) is guided through the yarn channel 3, the filaments of this yarn being interlaced at certain locations in the yarn channel by means of the blown air jet exiting from the air feed bore 5.

The yarn channel 3.1 of one embodiment of the air nozzle according to this invention, with the threading slot 4 and the air feed bore 5, is illustrated in FIG. 3 on an enlarged scale. The wall of the yarn channel 3.1 contains a circular-cylindrical baffle wall section 6.1 extending, symmetrically with respect to the plane E which contains the axis of the air feed bore 5 and is parallel to the longitudinal direction of the yarn channel 3.1, from the upper orifice rim 7 of the threading slot 4 to an end rim 8 located symmetrically in opposition to this orifice rim 7, and also contains a likewise circular-cylindrical nozzle wall section 9.1 extending, again symmetrically with respect to the plane E, from the lower orifice rim 10 of the threading slot 4 to an end rim 11 located symmetrically in opposition to the orifice rim 10. A transitional wall section 12.1 is disposed between the end rims 8 and 11. The axis of curvature A6 of the baffle wall section 6.1 and the axis of curvature A9 of the nozzle wall section 9.1 extend at a mutual spacing in parallel to each other, and the radius of curvature R6 of the baffle wall section 6.1 is smaller than the radius of curvature R9 of the nozzle wall section 9.1, namely in such a way that the tangential plane T laid on the baffle wall section 6.1 in the orifice rim 7 passes through the nozzle wall section 9.1. The orifice rim 10 of the threading slot 4 located in the nozzle wall section 9.1 thus lies—as seen from the interior of the yarn 3.1—outside of the tangential plane T. Therefore, the portion of the air stream exiting from the air feed bore 5 which is deflected toward the orifice rim 7 by the baffle wall section 6.1, as schematically indicated in FIG. 4, and which leaves the baffle wall section 6.1 at this orifice rim 7 approximately in the direction of the tangential plane T, does not enter the threading slot 4 but rather flows to the nozzle wall section 9.1 which latter further deflects the air stream portion away from the threading slot 4. The angle $\beta$ between the sides of the tangential plane T and of the nozzle wall section 9.1 facing the baffle wall section 6.1 is, for this purpose, an obtuse angle.

In contrast thereto, FIG. 5 shows schematically the conditions in a conventional air nozzle with a baffle wall section 6.2 and a nozzle wall section 9.2, lying on a joint circular-cylindrical area. The tangential plane T laid on the baffle wall section 6.2 in the orifice rim 7 passes through the lower boundary wall 14 of the threading slot 4. The partial air stream leaving the baffle wall section 6.2 at the orifice rim 7 in the direction of the tangential plane T is thus oriented toward the lower orifice rim 10 of the threading slot 4 and is partially deflected by the rim into the threading slot 4.

The symmetry of the yarn channel with respect to plane E in preferred embodiments of the air nozzle according to this invention, described in connection with FIG. 3, has the result that the tangential plane T.1 laid on the baffle wall section 6.1 in the end rim 8 forms the same angles with the plane of symmetry E and with the nozzle wall section 9.1 as the tangential plane T . For this reason, the air flow in the yarn channnel 3.1, schematically shown in FIG. 4, likewise becomes essentially symmetrical with respect to plane E. Owing to the symmetrical air flow, a tendency of the multifilament yarn to be interlaced toward lateral displacement, for example toward the threading slot 4, is counteracted. In order to refrain from interfering with the symmetry of the air stream, the transitional wall section 12.1 should not extend into the air stream, i.e. this section should be located—as seen from the interior of the yarn channel 3.1—outside of the tangential plane T.1.

A certain disturbance of the symmetry of the air flow in the yarn channel can result from the fact that air exits from the yarn channel through the threading slot 4, especially in the region of the ends of the yarn channel. This disturbance is counteracted by the embodiment as shown in FIG. 6.

In FIG. 6, identical parts bear the same reference numerals as in FIG. 3. The yarn channel 3.1 has the same configuration as in FIG. 3, with the baffle wall section 6.1 and the nozzle wall section 9.1. However, the transitional wall section 12.1 shown in FIG. 3 is replaced in FIG. 6 by the orifice of a slot 15 which is essentially symmetrical with respect to the threading slot 4 in relationship to plane E, this slot emanating from a relief duct 16. The relief duct 16, extending in parallel to the yarn channel 3.1 over the entire length of the swirl nozzle, is in communication with the surroundings so that the same flow conditions prevail in the slot 15 and at its orifice as exist in case of the threading slot 4.

The threading slot 4 exhibits boundary walls 13.1 and 14.1 extending preferably at a right angle to plane E.

In FIGS. 3 and 6, the baffle wall section 6.1 and the nozzle wall section 9.1 are each approximately circular-cylindrical. However, this is not a compulsory requirement; the wall sections could also exhibit other, continuously rounded cylindrical shapes, for example they could be oval or, for example, elliptical in cross section.

Figure 7:
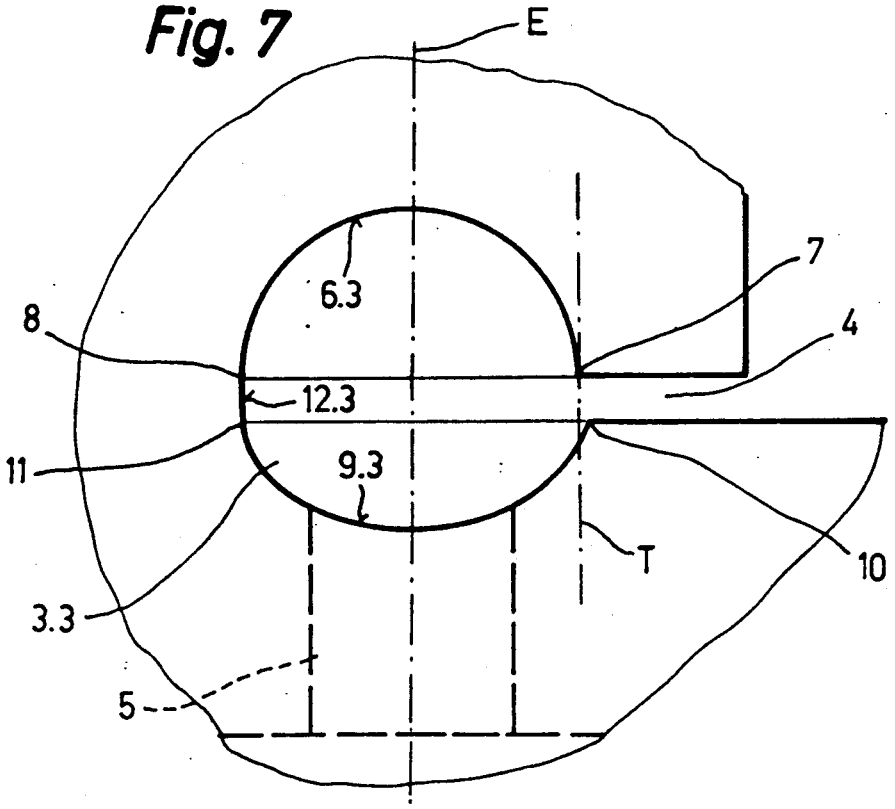

FIG. 7 shows the yarn channel 3.3 of a third embodiment of the air nozzle according to this invention. The threading slot 4 and the air feed bore 5 terminate laterally into the yarn channel 3.3. The wall of the yarn channel 3.3 contains a circular-cylindrical baffle wall section 6.3 extending, here also symmetrical with respect to plane E, from the upper orifice rim 7 of the threading slot 4 up to the end rim 8 which lies in symmetrical opposition to this orifice rim 7; and a nozzle wall section 9.3 having, in cross section, approximately the shape of an elliptic arch and extending from the lower orifice rim 10 of the threading slot 4 up to the rim 11 lying in symmetrical opposition to the orifice rim 10 with respect to plane E. A transitional wall section 12.3 is located between the end rims 8 and 11 which, in this embodiment, can be planar, for example. The tangential plane T laid on the baffle wall section 6.3 in the orifice rim 7 in this embodiment likewise does not extend into the threading slot 4 but rather passes through the nozzle wall section 9.3 emanating from this orifice rim.

On account of the feature that, in the air nozzle according to this invention, the baffle wall section and the nozzle wall section of the yarn channel do not lie on a common circular-cylindrical surface but rather exhibit each its own cylindrical shape, the advantageous possibility is likewise obtained of varying the proportion between the width of the yarn channel (measured perpendicularly to the plane of symmetry E) and the height of the yarn channel (measured perpendicularly to the width, i.e. in the plane E). In preferred embodiments, the width of the yarn channel is larger than its height.

The air nozzles according to this invention can be utilized advantageously in connection with spinning machines, namely especially for the interlacing of preliminarily oriented multifilament yarns (POY), but also of final-oriented (FOY) and of fully drawn (FDY) multifilament yarns.

What is claimed is:

1. An air nozzle for the interlacing of multifilament yarns, with a continuous yarn channel (3.1; 3.3) into which terminate laterally at least one air feed bore (5) and a threading slot (4), characterized in that the wall of the yarn channel (3.1; 3.3) comprises two wall sections of arcuate concave cross section, namely a baffle wall section (6.1; 6.3) lying in opposition to the orifice of the air feed bore (5) and a nozzle wall section (9.1; 9.3) proximate to the orifice of the air feed bore (5), the threading slot (4) terminating into the yarn channel (3.1; 3.3) between the baffle wall section and the nozzle wall section; and that the tangential plane (T) on the baffle wall section (6.1; 6.3) containing an orifice rim (7) of the threading slot (4) lying in the baffle wall section (6.1; 6.3) passes through the nozzle wall section (9.1; 9.3).

2. An air nozzle according to claim 1, characterized in that the baffle wall section (6.1; 6.3) and the nozzle wall section (9.1; 9.3) are each symmetrical with respect to a plane (E) containing the axis of the air feed bore (5) and being parallel to the longitudinal direction of the yarn channel (3.1; 3.3).

3. An air nozzle according to claim 2, characterized in that a transitional wall section (12.1: 12.3) is located between the end rim (8, 11) of the baffle wall section (6.1; 6.3) and of the nozzle wall section (9.1; 9.3) symmetrical to the orifice rims (7, 10) of the threading slot (4), this transitional wall section lying, as seen from the yarn channel (3.1; 3.3), outside of the tangential plane (T.1) on the baffle wall section, containing the end rim (8) of the baffle wall section (6.1; 6.3).

4. An air nozzle according to claim 2, characterized in that a second slot (15) emanating from a relief duct (16) terminates into the yarn channel (3.1) between the end rim (8, 11) of the baffle wall section (6.1) and of the nozzle wall section (9.1) symmetrical to the orifice rims (7, 10) of the threading slot (4).

5. An air nozzle according to claim 1, characterized in that the threading slot (4) has boundary walls (13.1, 14.1) which extend approximately perpendicularly to a plane (E) containing the axis of the air feed bore (5) and being in parallel to the longitudinal direction of the yarn channel (3.1; 3.3).

6. An air nozzle according to claim 5, characterized in that the baffle wall section (6.1; 6.3) is approximately circular-arc-shaped in cross section.

7. An air nozzle according to claim 6, characterized in that the nozzle wall section (9.1) is, in cross section, likewise approximately circular-arc-shaped wherein the axes of curvature (A6, A9) of the baffle wall section (6.1) and of the nozzle wall section (9.1) extend at a mutual spacing in parallel to each other.

8. An air nozzle according to claim 1, characterized in that the nozzle wall section (9.3) has approximately the shape of an elliptical arc in cross section.

9. An air nozzle to claim 6, characterized in that the nozzle wall section (9.1) is, in cross section, likewise approximately circular-arc-shaped wherein the baffle wall section (6.1) has a smaller radius of curvature (R6) than the nozzle wall section (9.1).

* * * * *